US005461892A

United States Patent [19]

Hsieh

[11] Patent Number: 5,461,892

[45] Date of Patent: Oct. 31, 1995

[54] FASTENER FOR A SUITCASE

[76] Inventor: Dick M. Hsieh, No. 18, Lane 777, Chung-Shan Rd., Kuei-Jen Hsiang, Tainan Hsien, Taiwan

[21] Appl. No.: 274,917

[22] Filed: Jul. 14, 1994

[51] Int. Cl.[6] ..... E05B 65/52

[52] U.S. Cl. ..... 70/73; 70/69; 292/247; 292/DIG. 49

[58] Field of Search ..... 70/69–76, 205; 292/113, DIG. 49, 247, 250

[56] References Cited

U.S. PATENT DOCUMENTS

| | | | |
|---|---|---|---|
| 2,710,214 | 6/1955 | Summers | 292/113 X |
| 2,714,032 | 7/1955 | Summers | 292/113 |
| 2,798,371 | 7/1957 | Gehrie | 70/73 |
| 2,829,912 | 4/1958 | Koch | 70/73 X |
| 2,921,810 | 1/1960 | Smith | 292/113 |
| 3,237,978 | 3/1966 | Swanson | 292/247 |
| 3,936,082 | 2/1976 | Swanson | 292/247 X |
| 4,782,673 | 11/1988 | Castelli et al. | 70/76 X |
| 5,060,492 | 10/1991 | Carpenter et al. | 70/73 |
| 5,216,905 | 6/1993 | Sersch et al. | 70/73 |
| 5,351,509 | 10/1994 | Visenzi | 70/73 |

FOREIGN PATENT DOCUMENTS

| | | | |
|---|---|---|---|
| 1222501 | 6/1960 | France | 292/113 |

*Primary Examiner*—Lloyd A. Gall
*Attorney, Agent, or Firm*—Ladas & Parry

[57] ABSTRACT

A suitcase fastener has a retaining member secured to the cover of a suitcase and a fastening assembly mounted on the case of the suitcase to engage the retaining member for holding the case and the cover together. The fastening assembly includes a base block with a receiving space. A first swing member has one end portion pivoted to the base block and another end portion biased away from the receiving space. A clasp member, pivoted to the other end portion of the first swing member, has a hook element and an engagement element at two end portions thereof and is biased to an unfolded position relative to the first swing member. The swing member and the clasp member are operable to be moved to their folded position in which the hook element is pressed to engage the retaining member and in which the other end portion of the first swing member and the engagement element of the clasp member are pressed into the receiving space. A second swing member, fulcrumed inside the receiving space, has a beak portion that is capable of engaging the engagement element when the engagement element is moved into the receiving space, and a tail portion that is capable of being pressed to release the beak portion from the engagement element so as to permit the swing member to be biased away from the receiving space and so as to disengage the hook element from the retaining member.

1 Claim, 5 Drawing Sheets

FASTENER FOR A SUITCASE

BACKGROUND OF THE INVENTION

1. Field of the Invention

This invention relates to a fastener for a suitcase, more particularly to a suitcase fastener which has an improved construction that can facilitate the operation of the suitcase fastener for closing the suitcase.

2. Description of the Related Art

The improvement of this invention is directed to a conventional suitcase fastener. Owing to the increasing popularity of traveling abroad, different suitcases are demanded according to the different needs of the travelers. Therefore, suitcase manufacturers have developed many new techniques to manufacture suitcases. For instance, through the use of an injection molding method, large-size suitcases can be manufactured at a relatively low manufacturing cost. Because the large-size suitcases are presently formed integrally from a plastic material by means of the injection molding method, the suitcase fastener has to be redesigned to facilitate the operation of the same by a user so as to match the application of the large-size suitcase.

SUMMARY OF THE INVENTION

Therefore, the main objective of this invention is to provide a suitcase fastener which has an improved construction that can facilitate the operation of the suitcase fastener for closing the suitcase.

According to this invention, a fastener for a suitcase includes a retaining member and a fastening assembly. The suitcase has a cover and a case which is formed with a peripheral wall. The retaining member is adapted to be mounted securely on the cover. The fastening assembly is adapted to be mounted on the peripheral wall of the case to engage the retaining member for holding the case and the cover together. The fastening assembly includes a base block, a first swing member, first biasing means, a clasp member, second biasing means, a second swing member, third biasing means, and a press plate.

The base block is fixed on the peripheral wall of the case and has a first end portion adjacent to the retaining member, a second end portion opposite to the first end portion, and a receiving space defined between the first and second end portions.

The first swing member has a first end portion mounted pivotally on the first end portion of the base block, and a second end portion opposite to the first end portion of the first swing member.

The first biasing means is capable of biasing the first swing member to move the second end portion of the first swing member away from the receiving space of the base block.

The clasp member has a hook element formed on one end portion thereof, and an engagement element formed on the other end portion thereof. The clasp member is mounted pivotally on the second end portion of the first swing element adjacent to the engagement element.

The second biasing means is capable of biasing the clasp member to an unfolded position relative to the first swing member when the second end portion of the first swing member is biased away from the receiving space of the base block.

The first swing member and the clasp member are operable to be moved against the first and second biasing means to a folded position of the swing member and the clasp member in which the hook element of the clasp member is depressed to engage the retaining member, and in which the second end portion of the first swing member and the engagement element of the clasp member are depressed into the receiving space of the base block.

The second swing member is fulcrumed at a location inside the receiving space of the base block between the first and second end portions of the base block. The second swing member has a beak portion extending toward the first end portion of the base block, and a tail portion extending toward the second end portion of the base block. The second swing member is turnable between a first position, in which the beak portion engages the engagement element of the clasp member when the engagement element is moved inward of the receiving space, and a second position in which the tail portion is depressed to release the beak portion from the engagement element, thereby permitting the first swing member to be biased away from the receiving space and thereby disengaging the hook element from the retaining member.

The third biasing means is capable of biasing the second swing member to the first position.

The press plate is mounted pivotally on the second end portion of the base block and is operable to depress the tail portion.

BRIEF DESCRIPTION OF THE DRAWINGS

Other features and advantages of this invention will became apparent in the following detailed description of a preferred embodiment of this invention, with reference to the accompanying drawings, in which.

DETAILED DESCRIPTION OF THE PREFERRED EMBODIMENT

Figure 2:
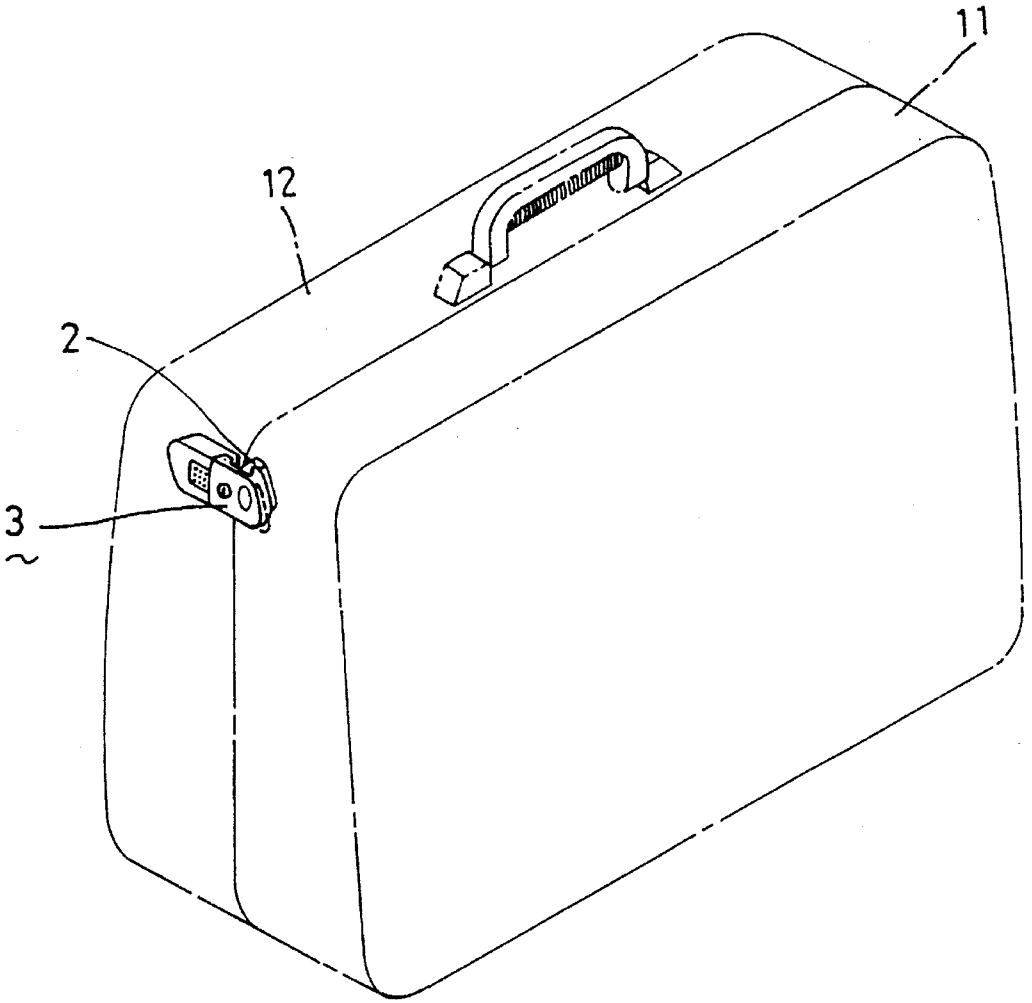
FIG. 2 is a perspective view showing the preferred embodiment of this invention when the fastener is operated to a locked position for closing the suitcase.

Referring to FIG. 2, the preferred embodiment of a fastener of this invention is to be applied on a suitcase for closing the same. The suitcase includes a cover 11 and a case 12 which is formed with a peripheral wall.

Figure 1:
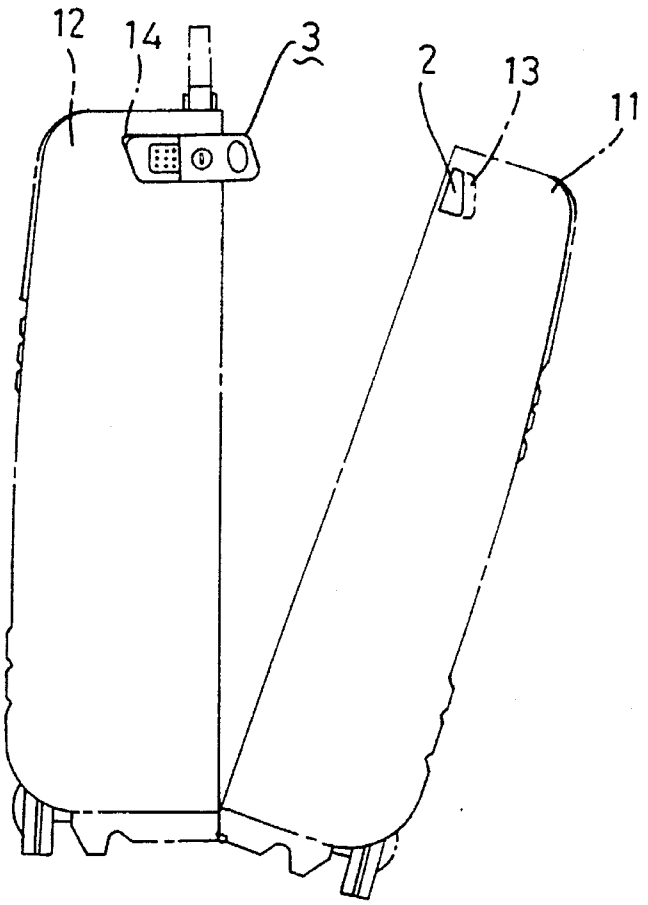
FIG. 1 is an elevational side view showing a preferred embodiment of a fastener of this invention when mounted to a suitcase.

Referring to FIG. 1, the cover 11 has a recess 13 formed in an outer surface thereof. The case 12 has a recess 14 formed in the peripheral wall thereof. The fastener includes a retaining member 2 which is mounted securely in the recess 13 of the cover 11, and a fastening assembly 3 which is mounted operably in the recess 14 of the case 12 and which is capable of engaging the retaining member 2 for holding the cover 11 and the case 12 together (see FIG. 2).

Figure 3:
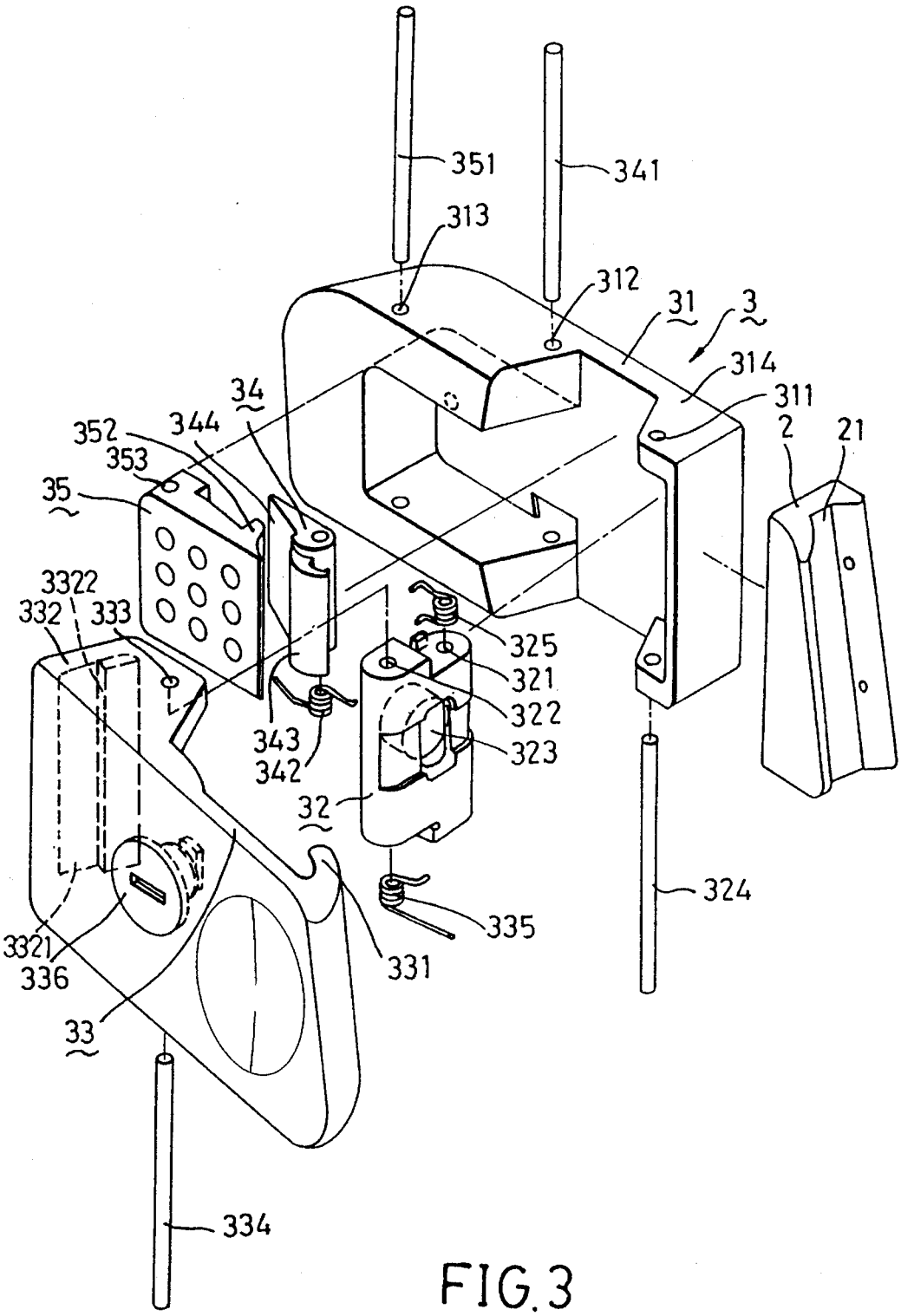
FIG. 3 is an exploded view showing the preferred embodiment of this invention.
Figure 4:
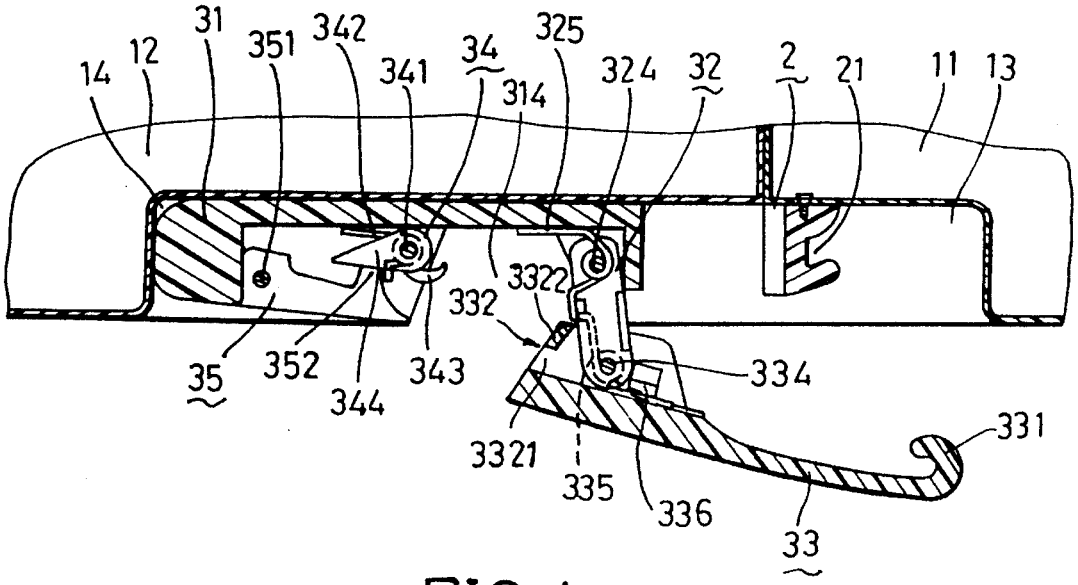
FIG. 4 is a sectional view illustrating the preferred embodiment of this invention when the fastener is at an unlocked position.

Referring to FIGS. 3 and 4, the retaining member 2 has a retaining space 21 confined therein. The fastening assembly 3 includes a base block 31 which is fixed within the recess 14 of the case 12 (see FIG. 4). The base block 31 has a first end portion which is located at a position adjacent to the retaining member 2 and which is formed with a pair of aligned first pivot holes 311, as shown in FIG. 3, a second end portion which is located at a position opposite to the first end portion and which is formed with a pair of aligned third pivot holes 313, a receiving space 314 defined between the first and second end portions, and a pair of aligned second pivot holes 312 formed through two opposite side walls of the base block 31 between the first and second end portions.

A first swing member 32 has a first end portion with a first pivot hole 321 formed therethrough and aligned with the first pivot holes 311 of the base block 31, a second end portion with a second pivot hole 322 formed therethrough, and a lock hole 323 formed in a central portion of a side surface of the first swing member 32. The first end portion of the first swing member 32 is mounted pivotally on the first end portion of the base block 31 by means of a pivot rod 324 which extends through the first pivot hole 321 of the first swing member 32 so as to be mounted pivotally to the first pivot holes 311 of the base block 31.

A first biasing means includes a first torsion spring 325 which is sleeved tightly on the pivot rod 324, as shown in FIG. 4, for biasing the first swing member 32 to move the second end portion of the first swing member 32 away from the receiving space 314 of the base block 31.

Referring again to FIG. 3, a clasp member 33 has a hook element 331 formed on one end portion thereof, and an engagement element 332 formed on the other end portion thereof. The engagement element 332 includes an engagement hole 3321 and a reinforcing plate 3322. The clasp member 33 further has a pair of aligned pivot holes 333 (only one is shown) formed in two opposite side walls thereof adjacent to the engagement element 332. The pivot holes 333 of the clasp member 33 are aligned with the second pivot hole 322 of the first swing member 32 so that the clasp member 33 can be mounted pivotally on the second end portion of the first swing element 32 by means of a pivot rod 334 which extends through the second pivot hole 322 of the first swing member 32 so as to be mounted pivotally to the pivot holes 333 of the clasp member 33.

A second biasing means includes a second torsion spring 335 which is sleeved tightly on the pivot rod 334, as shown in FIG. 4, for biasing the clasp member 33 to an unfolded position relative to the first swing member 32 when the second end portion of the first swing member 32 is biased away from the receiving space 314 of the base block 31.

Figure 6:
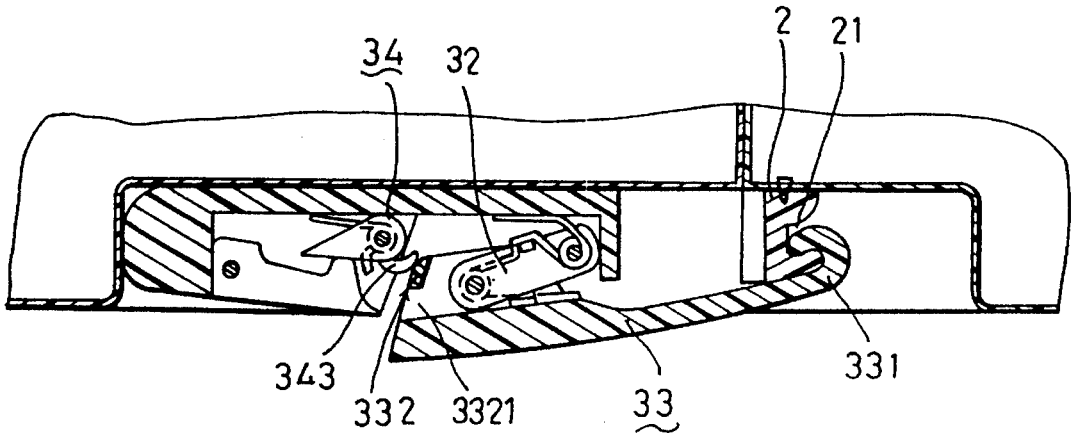
FIG. 6 is a sectional view illustrating the second step of operating the fastener to the locked position for closing the suitcase in accordance with the invention.

The first swing member 32 and the clasp member 33 are operable to be moved against the first and second torsion springs 325, 335 to their folded position, as shown in FIG. 6, in which the hook element 331 of the clasp member 33 is depressed to engage the retaining space 21 of the retaining member 2, and in which the second end portion of the first swing member 32 and the engagement element 332 of the clasp member 33 are depressed into the receiving space 314 of the base block 31.

Figure 5:
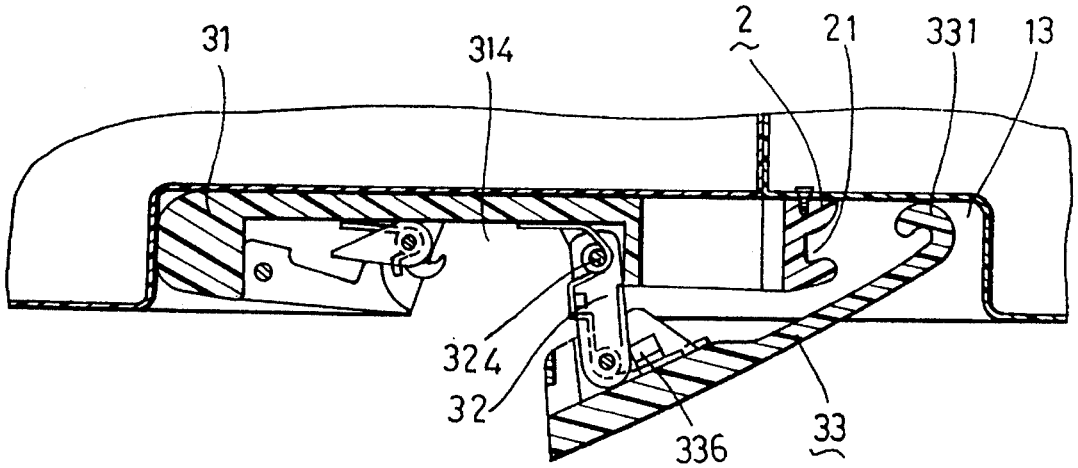
FIG. 5 is a sectional view illustrating the first step of operating the fastener to the locked position for closing the suitcase in accordance with this invention.

Referring again to FIG. 3, a second swing member 34 is fulcrumed at a location inside the receiving space 314 of the base block 31 between the first and second end portions of the base block 31 by means of a pivot rod 341 which extends through the second swing member 34 so as to be mounted pivotally to the second pivot holes 312 of the base block 31. The second swing member 34 has a beak portion 343 which extends toward the first end portion of the base block 31, and a tail portion 344 which extends toward the second end portion of the base block 31. The second swing member 34 is turnable between a first position, as shown in FIG. 7, in which the beak portion 343 engages the engagement hole 3321 of the engagement element 332 of the clasp member 33 when the engagement element 332 is moved inward of the receiving space 314 of the base block 31, and a second position, as shown in FIG. 8, in which the tail portion 344 is depressed to release the beak portion 343 from the engagement hole 3321 of the engagement element 332, thereby permitting the first swing member 32 to be biased away from the receiving space 314 of the base block 31, as shown in FIG. 5, and thereby disengaging the hook element 331 of the clasp member 33 from the retaining space 21 of the retaining member 2.

Figure 7:
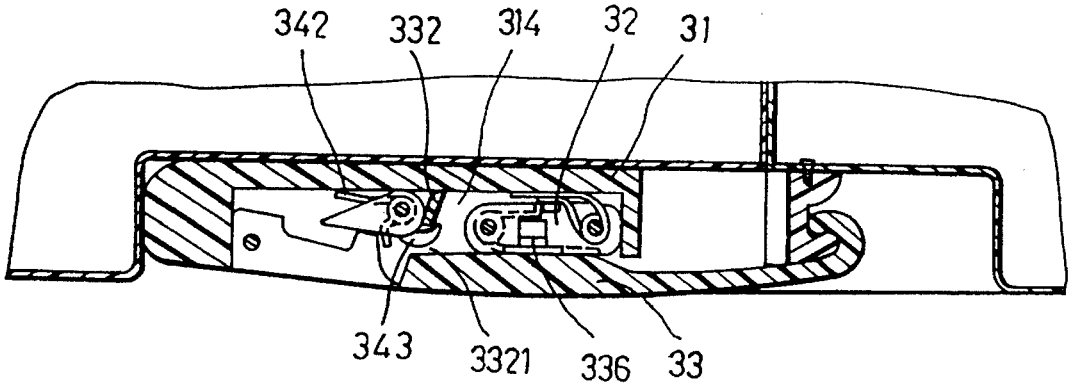
FIG. 7 is a sectional view illustrating the locked position of the fastener according to this invention.
Figure 8:
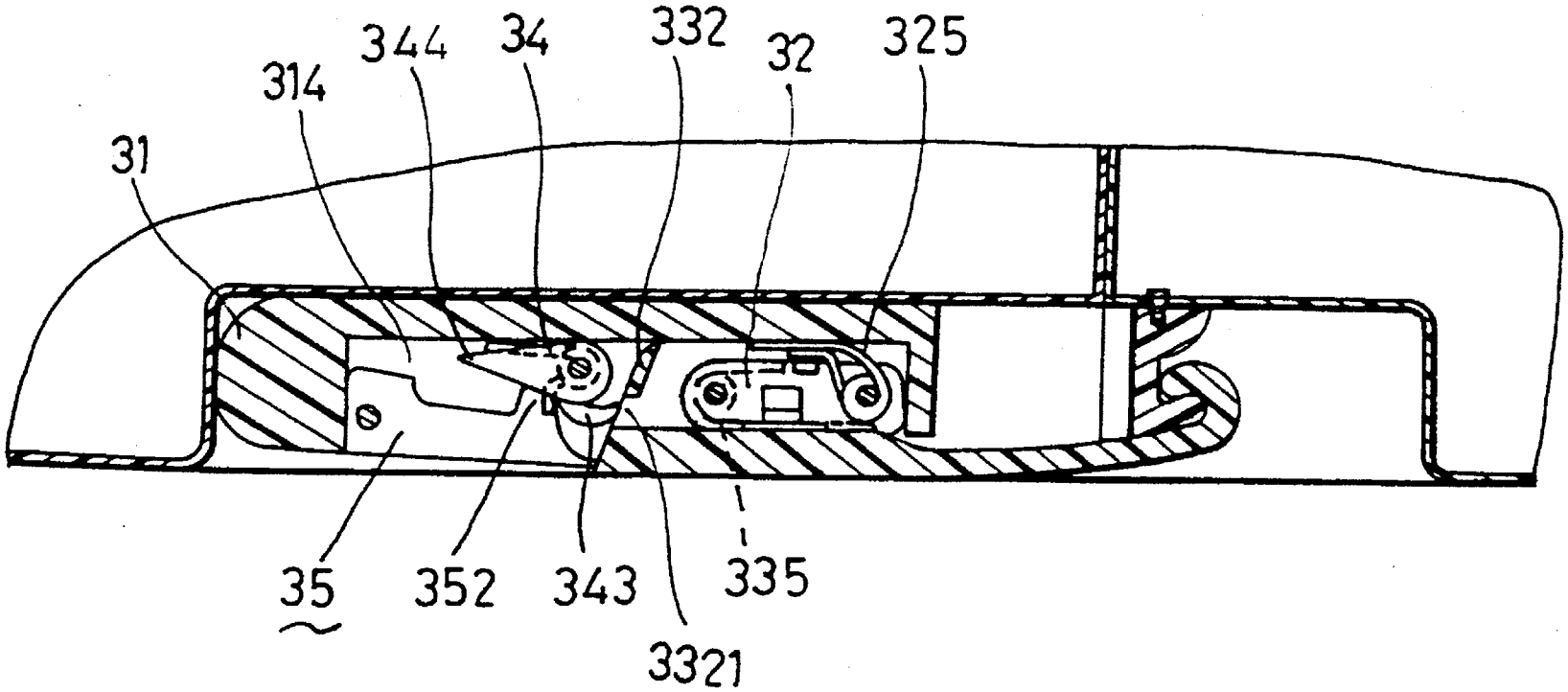
FIG. 8 is a sectional view illustrating how the fastener is operated to the unlocked position so as to open the suitcase in accordance with this invention.

A third biasing means includes a third torsion spring 342, as shown in FIG. 3, which is sleeved tightly on the pivot rod 341 for biasing the second swing member 34 to the first position in a known manner so that the beak portion 343 is engageable with the engagement hole 3321 of the engagement element 332 of the clasp member 33, as shown in FIG. 7.

Referring again to FIG. 3, a key-operated lock device 336 is mounted operably on a central portion of the clasp member 33 and can be inserted into the lock hole 323 of the first swing member 32. When the first swing member 32 and the clasp member 33 are at the folded position, as shown in FIG. 7, the key-operated lock device 336 can be operated in a known manner to prevent removal of the clasp member 33 from the first swing member 32, thereby preventing the first swing member 32 and the clasp member 33 from being biased to the unfolded position so as to lock the fastener.

A press plate 35, as shown in FIG. 3, is mounted pivotally on the second end portion of the base block 31 by means of a pivot rod 351 which extends through a pivot hole 353 of the press plate 35 so as to be mounted pivotally to the third pivot holes 313 of the base block 31. The press plate 35 has a protrusion 352 which lies on the tail portion 344 of the second swing member 34, as shown in FIG. 8, so that the press plate 35 is operable to depress the tail portion 344 of the second swing member 34.

Accordingly, when the key-operated lock device 336 is operated to an unlocked position, the tail portion 344 of the second swing member 34 can be depressed by depressing the press plate 35 so as to release the beak portion 343 of the second swing member 34 from the engagement hole 3321 of the engagement element 332, as shown in FIG. 8. At this same time, the second end portion of the first swing member 32 and the engagement element 332 of the clasp member 33 can be biased away from the receiving space 314 of the base block 31, as shown in FIG. 6. In this way, the hook element 331 of the clasp member 33 can be disengaged from the retaining space 21 of the retaining member 2, as shown in FIG. 5, thereby unlocking the fastener and enabling the cover 11 to be removed from the case 12, as shown in FIG. 1.

According to the above described operating manner, the fastener provides a distinct construction which can facilitate the operation of the fastener since the clasp member 33 needs only to be depressed to lock the fastener and since the press plate 35 needs only to be depressed to unlock the fastener.

With this invention thus explained, it is apparent that numerous modifications and variations can be made without departing from the scope and spirit of the invention. It is therefore intended that this invention be limited only as indicated in the appended claim.

I claim:

1. A fastener for a suitcase, said suitcase having a cover and a case which is formed with a peripheral wall, said fastener comprising a retaining member which is adapted to be mounted securely on said cover, and a fastening assembly which is adapted to be mounted on said peripheral wall of said case to engage said retaining member for holding said case and said cover together, said fastening assembly including:

a base block fixed on said peripheral wall of said case, said base block having a first end portion adjacent to said retaining member, a second end portion opposite to said first end portion, and a receiving space defined between said first and second end portions;

a first swing member having a first end portion mounted pivotally on said first end portion of said base block, and a second end portion opposite to said first end portion of said first swing member;

first biasing means for biasing said first swing member to move said second end portion of said first swing member away from said receiving space of said base block;

a clasp member having a hook element formed on one end portion thereof, and an engagement element formed on the other end portion thereof, said clasp member being mounted pivotally on said second end portion of said first swing member adjacent to said engagement element;

second biasing means for biasing said clasp member to an unfolded position relative to said first swing member when said second end portion of said first swing member is biased away from said receiving space of said base block;

said first swing member and said clasp member being operable to be moved against said first and second biasing means to a folded position of said first swing member and said clasp member in which said hook element of said clasp member is depressed to engage said retaining member, and in which said second end portion of said first swing member and said engagement element of said clasp member are depressed into said receiving space of said base block;

a second swing member fulcrumed at a location inside said receiving space of said base block between said first and second end portions of said base block, said second swing member having a beak portion extending toward said first end portion of said base block, and a tail portion extending toward said second end portion of said base block, said second swing member being turnable between a first position, in which said beak portion engages said engagement element of said clasp member when said engagement element is moved inward of said receiving space, and a second position in which said tail portion is depressed to release said beak portion from said engagement element, thereby permitting said first swing member to be biased away from said receiving space and thereby disengaging said hook element from said retaining member;

third biasing means for biasing said second swing member to said first position; and a press plate mounted pivotally on said second end portion of said base block and operable to depress said tail portion.

* * * * *